United States Patent [19]

Lamm

[11] 3,947,162

[45] Mar. 30, 1976

[54] RADIAL SEAL FOR A ROTARY PISTON INTERNAL COMBUSTION ENGINE

[75] Inventor: Heinz Lamm, Esslingen-St. Bernhardt, Germany

[73] Assignee: Daimler-Benz Aktiengesellschaft, Germany

[22] Filed: Sept. 25, 1974

[21] Appl. No.: 509,305

[30] Foreign Application Priority Data

Sept. 29, 1973 Germany ..... 2349093

[52] U.S. Cl. ..... 418/121; 418/122

[51] Int. Cl.[2] ..... F01C 19/04; F04C 27/00

[58] Field of Search ..... 418/121, 122, 123, 113

[56] References Cited

UNITED STATES PATENTS

| | | | |
|---|---|---|---|
| 3,161,350 | 12/1964 | Lorcher | 418/122 |
| 3,400,691 | 9/1968 | Jones | 418/121 |
| 3,667,877 | 6/1972 | Lamm | 418/121 |

FOREIGN PATENTS OR APPLICATIONS

| | | | |
|---|---|---|---|
| 1,196,030 | 7/1965 | Germany | 418/122 |
| 1,245,636 | 7/1967 | Germany | 418/121 |

*Primary Examiner*—John J. Vrablik

*Attorney, Agent, or Firm*—Craig & Antonelli

[57] ABSTRACT

A radial seal for a rotary piston internal combustion engine, especially of trochoidal construction, which is constituted by a sealing bar, possibly of multi-partite construction, that is guided in an axially parallel groove of a piston and is forced radially outwardly by springs; the springs are thereby arranged separate from one another in series one behind the other—as viewed in the longitudinal direction of the groove.

8 Claims, 2 Drawing Figures

RADIAL SEAL FOR A ROTARY PISTON INTERNAL COMBUSTION ENGINE

Figure 1:
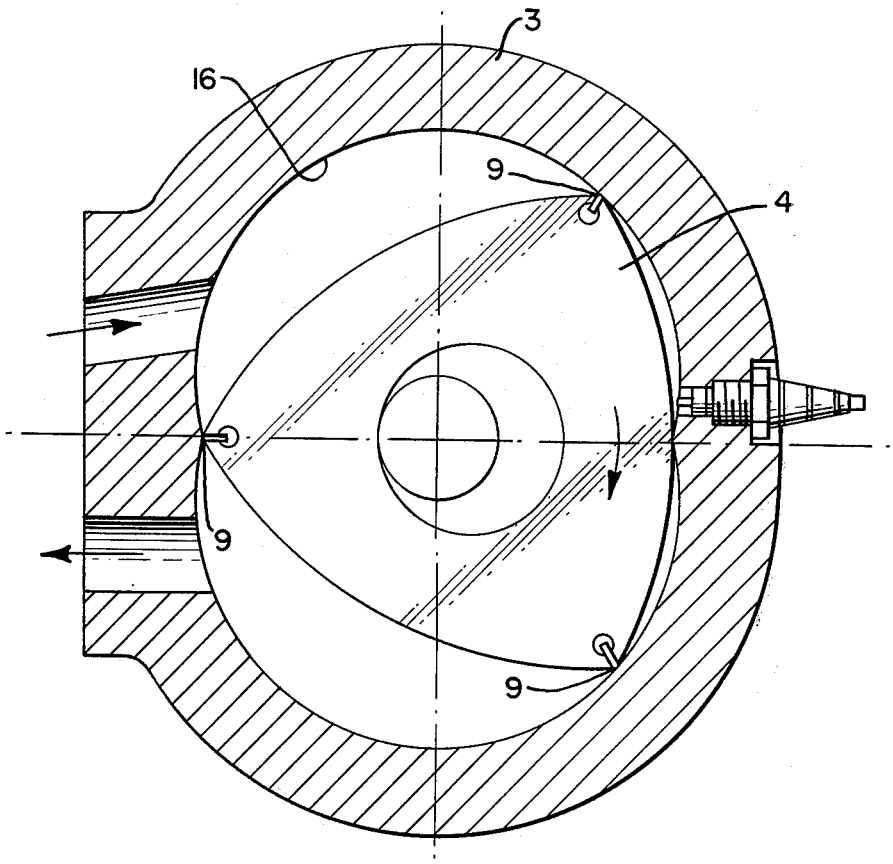

The present invention relates to a radial seal for a rotary piston internal combustion engine, especially of trochoidal type of construction, essentially consisting of a radial sealing bar possibly of multi-partite construction which is guided in an axially parallel groove of a piston and is forced outwardly in the radial direction by springs.

It is known in connection with three-partite sealing bars to arrange in a sealing bar groove two leaf springs of different construction as regards the length, one above the other in such a manner that the ends of the large leaf spring abut at the corner parts and the ends of the small leaf spring at the center part of the sealing bar.

Such double-spring constructions entail the disadvantage that two different spring sizes are required and two leg portions for each spring are necessitated as stop means against lateral displacement. Additionally, the assembly is difficult and time-consuming.

The aim of the present invention is to eliminate these disadvantages in a simple manner.

The underlying problems are solved according to the present invention in that the springs are separately arranged one behind the other--as viewed in the longitudinal direction of the groove.

In a preferred embodiment according to the present invention the center part of the three-partite sealing bar is provided with a centrally arranged small leg portion and one leaf spring each is arranged between this centrally arranged leg portion and the small leg portion of the corresponding corner part, whereby the arcuate portions of the leaf springs are supported at the groove bottom and the free ends thereof abut at the sealing bar.

Only one limit means against lateral displacement is thus required for both springs in the center part of the sealing bar. Furthermore, by the use of uniform leaf springs the part's supply and the assembly is more simple and more safe.

A further advantage of the present invention resides in that one point of engagement each of both srings is disposed in the center of the center part of the sealing bar and each spring operates separately as a result thereof with the corresponding corner part. The center part thereby becomes more capable of adaptation and all parts of the sealing bar become more gas-tight. The consequence thereof is a greater insensitivity to chattering.

Accordingly, it is an object of the present invention to provide a radial seal for a rotary piston internal combustion engine which avoids by simple means the aforementioned shortcomings and drawbacks encountered in the prior art.

Another object of the present invention resides in a radial seal for a rotary piston internal combustion engine which eliminates the need for different spring sizes and reduces the number of abutments required to prevent lateral displacements of the springs.

A further object of the present invention resides in a radial seal for a rotary piston internal combustion engine which facilitates the assembly and reduces the time required in connection therewith.

Still a further object of the present invention resides in a radial seal for a rotary piston internal combustion engine which entails considerable advantages as regards improved operating characteristics, particularly as regards greater gas-tightness and greater insensitivity against chattering.

Figure 2:
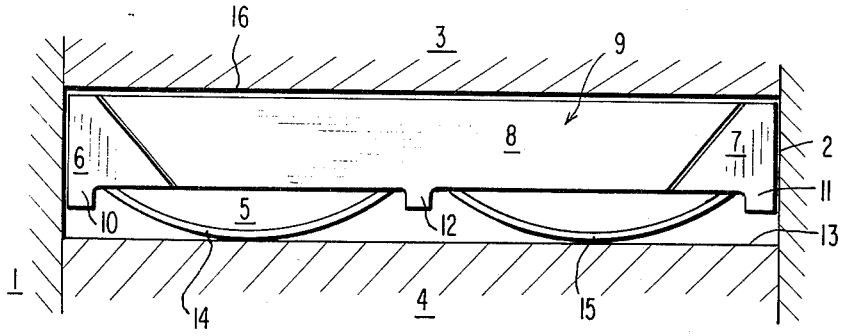

These and further objects, features and advantages of the present invention will become more apparent from the following description when taken in connection with the accompanying drawing which shows, for purposes of illustration only, one embodiment in accordance with the present invention, and wherein:

FIG. 1 is a somewhat schematic cross-sectional view through a rotary piston internal combustion engine of trochoidal construction having radial seals in accordance with the present invention; and FIG. 2 is a partial, somewhat schematic crosssectional view through a radial seal in accordance with the present invention.

Referring now to FIGS. 1 and 2 of the drawings wherein like reference numerals are used in both views to designate like parts, the rotary piston internal combustion engine which is only schematically indicated, is of conventional construction and includes a housing consisting of the lateral parts 1 and 2 and of the housing casing 3. A rotatable piston 4 is arranged within the housing of the rotary piston internal combustion engine which rotates in the usual manner so that its piston corners slide along the inner surface 16 of the housing casing 3 which is, for example, of trochoidal construction. The piston 4 is provided with grooves 5 in the corners thereof, in which one three-partite sealing bar each generally designated by reference numeral 9 and consisting of two corner parts 6 and 7 and of a center part 8 is guided. Each corner part 6, 7 is provided within the area of the lateral part 1, 2 with a small leg portion 10, 11 whereas the center part 8 is provided with a small leg portion 12 in the longitudinal center thereof. Two leaf springs 14 and 15 which are arranged one behind the other—as viewed in the longitudinal direction of the groove—and which are bent similar to a bow, support themselves underneath the sealing bar 9 against the groove bottom 13 of the groove 5; of these two leaf springs 14 and 15, the leaf spring 14 is arranged between the small leg portions 10 and 12 and the leaf spring 15 between the leg portions 12 and 11. The free ends of the springs 14 and 15 abut, on the one hand, at a corner part 6, 7 and, on the other, at the center part 8 of the sealing bar 9. The leg portions 10, 11 and 12 serve as limit or stop means against lateral displacement of the springs 14 and 15. The center part 8 and the corner parts 6 and 7 are pressed radially outwardly against the casing contact surface 16 of the housing casing 3 by the spring force of the springs 14 and 15.

While I have shown and described only one embodiment in accordance with the present invention, it is understood that the same is not limited thereto but is susceptible of numerous changes and modifications as known to those skilled in the art, and I therefore do not wish to be limited to the details shown and described herein, but intend to cover all such changes and modifications as are encompassed by the scope of the appended claims.

I claim:

1. A radial seal for a rotary piston internal combustion engine which comprises radial sealing bar means guided in a groove means of a piston of the engine and forced radially outwardly by spring means, characterized in that the spring means are arranged separate from one another and one behind the other, as viewed in the longitudinal direction of the groove means, the sealing bar means is constructed three-partite and consists of a center part and two corner parts with leg portions, and in that the center part is provided with a substantially centrally arranged leg portion, one spring means each is arranged between said centrally arranged leg portion and the leg portion of the corresponding corner part, said center part includes an inclined surface portion at respective lateral edges thereof, each of said corner portions including a complimentary surface adjoining the respective inclined surface portions of said center part.

2. A radial seal according to claim 1, characterized in that the rotary piston internal combustion engine is of trochoidal construction.

3. A radial seal according to claim 1, characterized in that the groove means is disposed substantially axially parallelly.

4. A radial seal according to claim 1, characterized in that each spring means is a leaf spring means, and the leaf spring means are bowed and supported with the arcuate portions thereof at the groove bottom and abut with the free ends thereof at the sealing bar means.

5. A radial seal according to claim 4, characterized in that the groove means is disposed substantially axially parallelly.

6. A radial seal according to claim 4, characterized in that the rotary piston internal combustion engine is of trochoidal construction.

7. A radial seal for a rotary piston engine, the engine includes a casing having disposed on respective sides thereof lateral parts, radial sealing means guided in a groove means of a piston of the engine, and spring means for forcing the radial sealing means radially outwardly, the improvement comprising: a three-part radial sealing bar means forming said radial sealing means, said radial sealing bar means consisting of a center part and a corner part disposed at each respective lateral edge of said center part, leg portions provided on each of said corner parts extending downwardly in the direction of the bottom of the groove means, said leg portions being provided on each of said corner parts at a side thereof adjacent the respective lateral parts of the engine, a centrally arranged leg portion provided on said center part of said radial sealing bar means extending downwardly in the direction of the bottom of said groove means, the spring means includes one leaf spring means each disposed between said centrally arranged leg portion and the respective leg portions of said corner parts, said center part includes an inclined surface portion at respective lateral edges thereof, each of said corner portions including a complimentary surface adjoining the respective inclined surface portions of said center part.

8. A radial seal according to claim 7, wherein said leaf spring means are bowed with the arcuate portions thereof abutting the bottom of the groove means, one free end of each of said spring means abutting said center part and the other free end of each of said leaf spring means abutting a respective corner part.

* * * * *